US009252480B2

(12) United States Patent
Chiu et al.

(10) Patent No.: US 9,252,480 B2
(45) Date of Patent: Feb. 2, 2016

(54) TWO-SHAFT HINGE ANTENNA AND FOLDABLE ELECTRONIC DEVICE USING THE SAME

(71) Applicant: Advanced-Connetek Inc., New Taipei (TW)

(72) Inventors: Tsung-Wen Chiu, New Taipei (TW); Fu-Ren Hsiao, New Taipei (TW); Chih-Fan Chen, New Taipei (TW); Pei-Feng Wu, New Taipei (TW)

(73) Assignee: ADVANCED-CONNETEK INC., New Taipei (TW)

( * ) Notice: Subject to any disclaimer, the term of this patent is extended or adjusted under 35 U.S.C. 154(b) by 216 days.

(21) Appl. No.: 14/143,731

(22) Filed: Dec. 30, 2013

(65) Prior Publication Data

US 2015/0102966 A1 Apr. 16, 2015

(30) Foreign Application Priority Data

Oct. 14, 2013 (TW) ..... 102137034 A

(51) Int. Cl.
*H01Q 1/24* (2006.01)
*H01Q 1/22* (2006.01)
*H01Q 7/00* (2006.01)

(52) U.S. Cl.
CPC ..... *H01Q 1/2266* (2013.01); *H01Q 1/243* (2013.01); *H01Q 7/00* (2013.01)

(58) Field of Classification Search
USPC ..... 343/702, 872, 893, 700 MS
See application file for complete search history.

(56) References Cited

U.S. PATENT DOCUMENTS 6,301,489 B1 * 10/2001 Winstead ..... H01Q 1/084 343/702
6,353,733 B1 * 3/2002 Murray ..... H04M 1/0216 343/702

* cited by examiner

*Primary Examiner* — Sue A Purvis
*Assistant Examiner* — Jae Kim
(74) *Attorney, Agent, or Firm* — Muncy, Geissler, Olds & Lowe, P.C.

(57) ABSTRACT

A two-shaft hinge antenna comprises a major conductor, a first rotating element and a second rotating element. The stretching arms on both sides of the major conductor are assembled to the first rotating element and the second rotating element, respectively. The first rotating element further comprises a torque device and a first vice conductor, and the second rotating element further comprises a signal feeding line, a connection device, and a second vice conductor. The signal feeding line is electrically connected to the connection device and the second vice conductor, by which a high frequency signal can be passed to the major conductor, and then passed to the torque device on the other side and the first vice conductor. The aforementioned configuration is utilized to form an antenna loop. In addition, the configuration of this antenna can be applied to a foldable electronic device.

9 Claims, 13 Drawing Sheets

TWO-SHAFT HINGE ANTENNA AND FOLDABLE ELECTRONIC DEVICE USING THE SAME

BACKGROUND OF THE INVENTION

1. Technical Field

The present invention relates to a hinge antenna structure, and in particular to a two-shaft hinge antenna structure which can be used in a foldable electronic device. In the present invention, an antenna transmitting element is integrated into a rotating mechanism joined by a foldable electronic device, such that the two-shaft hinge antenna can be accommodated within the space in the foldable electronic device, and the cover can move relatively to the device body for performing either opening or closing motion. With such antenna structure, the effects of stabilization in structure, simplification in assembly and unification in appearance can be achieved.

2. Description of the Prior Art

With the rapid development of technologies, a variety of portable 3C electronic devices provide convenience for human life, and thus become indispensible. In recent years, due to the rapid growth of wireless communication, a large amount of data is transmitted to portable 3C electronic devices via wireless networks. As been an integrated configuration of portable 3C electronic device, it is necessary for antennas to be built in the 3C electronic device for receiving signals sent from wireless base stations. For example, it is common to see travelling people carrying laptops and communicating via networks for attaining needed information. The antenna is built in each laptop for receiving signals.

Referring to FIG. 8, it is a schematic view showing a conventional antenna structure. As shown in FIG. 8, in general, one antenna is disposed on each of the left and right sides of the upper end of the laptop display screen in a symmetric manner, and the high-frequency coaxial cables are employed for the transmission of signals, as indicated in the dashed line in the figure. Since signal degradation, such as insertion loss, occurs when signals are transmitted by using coaxial cables, the effective transmission distance and signal quality are reduced. In addition, such signal degradation is more severe in the coaxial cable during wireless transmission in higher frequency. Moreover, the shell of the laptops are commonly made of metal which creates shielding effect and as results the signal reception of the antenna is affected.

SUMMARY OF THE INVENTION

In view of the aforementioned long-existing problems, the present invention provides a two-shaft hinge antenna, which can be effectively accommodated within a first housing and a second housing of a foldable electronic device. A rotating mechanism enables the first housing to rotate with respect to the second housing. In such two-shaft hinge antenna, stretching arms on both sides of a major conductor are respectively assembled to a connection device for signal transmitting and a torque device, so as to form a hinge antenna structure, which can directly transmit a high frequency signal to outer housings of the electronic device (i.e. the first housing and the second housing) and form an antenna loop for improving the efficiency of signal transmission. Moreover, due to the increase of the radiation area the performance of antenna is raised. With the design of the two-shaft hinge antenna of the present invention, the effects of stabilization in structure, simplification in assembly and unification in appearance can be achieved without affecting the signal-receiving quality of the antenna.

According to the description above, a major objective of the present invention is to provide a two-shaft hinge antenna including a major conductor, a first rotating element and a second rotating element. The stretching arms on both sides of the major conductor are respectively connected to the first rotating element and the second rotating element to form an assembly, wherein the first rotating element includes a torque device and a first vice conductor, and the second rotating element includes a signal feeding line, a connection device and a second vice conductor. After assembling the signal feeding line to the connection device and the second vice conductor, the high frequency signal can be transmitted to the major conductor, and further to the torque device and the first vice conductor on the other end to form an antenna loop. Therefore, there is no need to additionally install a micro scale antenna that may influence the quality of electromagnetic signal transmission and reception. As resulted, the effects of structure stabilization, assembly simplification and appearance unification can be achieved.

Another major objective of the present invention is to provide a two-shaft hinge antenna, including a major conductor, a first rotating element and a second rotating element. The stretching arms on both sides of the major conductor are respectively connected to the first rotating element and the second rotating element to form an assembly, wherein the first rotating element includes a torque device and a first vice conductor, and the second rotating element includes a signal feeding line, a connection device and a microwave base plate. After the signal feeding line is electrically connected to the microwave base plate, the high frequency signal can be transmitted to the major conductor through the connection device provided on the microwave base plate, and further to the torque device and the first vice conductor on the other end to form an antenna loop. In the configuration, the connection device is made of conductive materials, for example, a metal clip or a gear. It is with other members connected to the major conductor. The described two-shaft hinge antenna itself is an antenna body, so there is no need to additionally install a micro scale antenna that may influence the quality of electromagnetic signal transmission and reception. As resulted, the effects of structure stabilization, assembly simplification and appearance unification can be achieved.

Still another major objective of the present invention is to provide a two-shaft hinge antenna including a major conductor, a first rotating element and a second rotating element. The stretching arms on both sides of the major conductor are respectively connected to the first rotating element and the second rotating element to form an assembly, wherein the first rotating element includes a torque device and a first vice conductor, and the second rotating element includes a signal feeding line, a connection device and a microwave base plate. After the signal feeding line is electrically connected to the microwave base plate, the high frequency signal can be transmitted to the major conductor through the connection device provided on the microwave base plate, and further to the torque device and the first vice conductor on the other end to form an antenna loop. In the configuration, the connection device is made of conductive materials, for example, a metal clip or a metal spring sheet. It is directly connected to the major conductor. The described two-shaft hinge antenna itself is an antenna body, so there is no need to additionally install a micro scale antenna that may influence the quality of electromagnetic signal transmission and reception. As resulted the effects of structure stabilization, assembly simplification and appearance unification can be achieved.

Another major objective of the present invention is to provide a two-shaft hinge antenna accommodated within a first housing and a second housing of a foldable electronic device. The stretching arms on both sides of a major conductor are respectively connected to a first rotating element and a second rotating element to form an assembly, wherein the first rotating element includes a torque device and a first vice conductor, and the second rotating element includes a signal feeding line, a connection device and a second vice conductor. After assembling the signal feeding line to the connection device and the second vice conductor, the high frequency signal can be transmitted to the major conductor, and further to the torque device and the first vice conductor on the other end to form an antenna loop as whole. The described two-shaft hinge antenna itself is an antenna body, so there is no need to additionally install a micro scale antenna that may influence the quality of electromagnetic signal transmission and reception, and shielding effect of metals can be suppressed.

Another major objective of the present invention is to provide a two-shaft hinge antenna accommodated within a first housing and a second housing of a foldable electronic device. The stretching arms on both sides of a major conductor are respectively connected to a first rotating element and a second rotating element to from an assembly, wherein the first rotating element includes a torque device and a first vice conductor, and the second rotating element includes a signal feeding line, a connection device and a microwave base plate. After the signal feeding line is electrically connected to the microwave base plate, the high frequency signal can be transmitted to the major conductor through the connection device provided on the microwave base plate and configured to transmit signals, and further to the torque device and the first vice conductor on the other end to form an antenna loop. The connection device is formed with conductive materials, for example, a metal clip or a gear. It is with other members connected to the major conductor. The described two-shaft hinge antenna itself is an antenna body, so there is no need to additionally install a micro scale antenna that may influence the quality of electromagnetic signal transmission and reception. Moreover, shielding effect from metals can be suppressed.

The last major objective of the present invention is to provide a two-shaft hinge antenna accommodated within a first housing and a second housing of a foldable electronic device. The stretching arms on both sides of a major conductor are respectively connected to a first rotating element and a second rotating element to form an assembly, wherein the first rotating element includes a torque device and a first vice conductor, and the second rotating element includes a signal feeding line, a connection device and a microwave base plate. After the signal feeding line is electrically connected to the microwave base plate, the high frequency signal can be transmitted to the major conductor through the connection device provided on the microwave base plate and configured to transmit signals, and further to the torque device and the first vice conductor on the other end to form an antenna loop. The connection device is formed with conductive materials, for example, a metal clip or a metal spring sheet. It is directly connected to the major conductor. The described two-shaft hinge antenna itself is an antenna body, so there is no need to additionally install a micro scale antenna that may influence the quality of electromagnetic signal transmission and reception. Moreover, shielding effect from metals can be suppressed.

According to the objectives above, the present invention provides a two-shaft hinge antenna, comprising a major conductor provided with stretching arms on both sides thereof, a first insertion hole and a second insertion hole being provided on the ends of the stretching arms, respectively; a first rotating element configured to be mounted to the first insertion hole of the stretching arm on a side of the major conductor, wherein the first rotating element comprises a first vice conductor, a stretching arm on a side thereof is provided with a first fitting hole; a torque device including a rotating shaft and a plurality of fastening elements, wherein one end of the rotating shaft is mounted to the first insertion hole with a first fastening element, while the other end thereof penetrates the first fitting hole of the first vice conductor for mounting the first vice conductor to the torque device; and a second rotating element configured to be mounted to the second insertion hole of the stretching arm on the other side of the major conductor, wherein the second rotating element comprises a second vice conductor having a connecting plate with a second fitting hole provided thereon; a connection device, one end thereof being mounted to the second insertion hole with a second fastening element, while the other end thereof penetrating the second fitting hole of the second vice conductor, the second vice conductor being mounted to the connection device with a third fastening element; and a signal feeding line having a positive end signal lead and a negative end signal lead, wherein the signal feeding line is inserted into the connection device and integrally mounted to the connection device with the third fastening element, in order to transmit a high frequency signal to the major conductor, and further to the torque device connected to the major conductor for forming an antenna loop together with the first vice conductor.

According to the objectives above, the present invention provides a two-shaft hinge antenna, comprising: a major conductor provided with stretching arms on both sides thereof, a first insertion hole and a second insertion hole being provided on the ends of the stretching arms, respectively; a first rotating element configured to be mounted to the first insertion hole of the stretching arm on a side of the major conductor, wherein the first rotating element comprises a first vice conductor, a stretching arm on a side thereof is provided with a first fitting hole; a torque device including a rotating shaft and a plurality of fastening elements, wherein one end of the rotating shaft is mounted to the first insertion hole with a first fastening element, while the other end thereof penetrates the first fitting hole of the first vice conductor for mounting the first vice conductor to the torque device; and a second rotating element configured to be mounted to the second insertion hole of the stretching arm on the other side of the major conductor, wherein the second rotating element comprises a signal feeding line configured to transmit a high frequency signal and having a positive end signal lead and a negative end signal lead; a microwave base plate having a signal feed-in section and a grounding section, the signal feed-in section including a signal pad electrically connected to the positive end signal lead of the signal feeding line, and the grounding section including a fixing pad for fixing the negative end signal lead of the signal feeding line to the grounding section; and a connection device, one end thereof being connected to the signal pad of the microwave base plate, while the other end thereof being connected to the major conductor for transmitting the high frequency signal to the major conductor, and further to the torque device connected to the major conductor for forming an antenna loop together with the first vice conductor.

According to the objectives above, the present invention provides a two-shaft hinge antenna, comprising a major conductor provided with stretching arms on both sides thereof, an insertion hole being provided on an end of the stretching arm on a side of the major conductor; a first rotating element configured to be mounted to the insertion hole of the stretching arm on a side of the major conductor, wherein the first rotating element comprises a first vice conductor, a stretching arm on a side thereof is provided with a first fitting hole; a torque device including a rotating shaft and a plurality of fastening elements, wherein one end of the rotating shaft is mounted to the insertion hole with a first fastening element, while the other end thereof penetrates the first fitting hole of the first vice conductor for mounting the first vice conductor to the torque device; and a second rotating element configured to be mounted to the stretching arm on the other side of the major conductor, wherein the second rotating element comprises a signal feeding line configured to transmit a high frequency signal and having a positive end signal lead and a negative end signal lead; a microwave base plate having a signal feed-in section and a grounding section, the signal feed-in section including a signal pad electrically connected to the positive end signal lead of the signal feeding line, and the grounding section including a fixing pad for fixing the negative end signal lead of the signal feeding line to the grounding section; and a connection device, one end thereof being connected to the signal pad of the microwave base plate, while the other end thereof being connected to the major conductor for transmitting the high frequency signal to the major conductor, and further to the torque device connected to the major conductor for forming an antenna loop together with the first vice conductor.

According to the objectives above, the present invention provides a foldable electronic device, comprising at least a rotating mechanism, a first housing and a second housing, the rotating mechanism including an accommodating space and a two-shaft hinge antenna disposed in the accommodating space, the rotating mechanism enabling the first housing to be rotatable with respect to the second housing, wherein the two-shaft hinge antenna comprises a major conductor connected to the first housing and provided with opposing stretching arms on both sides thereof, a first insertion hole and a second insertion hole being provided on the ends of the stretching arms, respectively; a first rotating element configured to be mounted to the first insertion hole of the stretching arm on a side of the major conductor, wherein the first rotating element comprises a first vice conductor, a stretching arm on a side thereof is provided with a first fitting hole; a torque device including a rotating shaft and a plurality of fastening elements, wherein one end of the rotating shaft is mounted to the first insertion hole with a first fastening element, while the other end thereof penetrates the first fitting hole of the first vice conductor for mounting the first vice conductor to the torque device; and a second rotating element configured to be mounted to the second insertion hole of the stretching arm on the other side of the major conductor, wherein the second rotating element comprises a second vice conductor having a connecting plate with a second fitting hole provided thereon; a connection device, one end thereof being mounted to the second insertion hole with a second fastening element, while the other end thereof penetrating the second fitting hole of the second vice conductor, the second vice conductor being mounted to the connection device with a third fastening element; and a signal feeding line having a positive end signal lead and a negative end signal lead, wherein the signal feeding line is inserted into the connection device and integrally mounted to the connection device with the third fastening element, in order to transmit a high frequency signal to the major conductor and the first housing connected thereto, and further to the torque device connected to the major conductor for forming an antenna loop together with the first vice conductor and the second housing connected thereto.

According to the objectives above, the present invention provides a foldable electronic device, comprising at least a rotating mechanism, a first housing and a second housing, the rotating mechanism including an accommodating space and a two-shaft hinge antenna disposed in the accommodating space, the rotating mechanism enabling the first housing to be rotatable with respect to the second housing, wherein the two-shaft hinge antenna comprises a major conductor connected to the first housing and provided with opposing stretching arms on both sides thereof, a first insertion hole and a second insertion hole being provided on the ends of the stretching arms, respectively; a first rotating element configured to be mounted to the first insertion hole of the stretching arm on a side of the major conductor, wherein the first rotating element comprises a first vice conductor, a stretching arm on a side thereof is provided with a first fitting hole; a torque device including a rotating shaft and a plurality of fastening elements, wherein one end of the rotating shaft is mounted to the first insertion hole with a first fastening element, while the other end thereof penetrates the first fitting hole of the first vice conductor for mounting the first vice conductor to the torque device; and a second rotating element configured to be mounted to the second insertion hole of the stretching arm on the other side of the major conductor, wherein the second rotating element comprises a signal feeding line configured to transmit a high frequency signal and having a positive end signal lead and a negative end signal lead; a microwave base plate having a signal feed-in section and a grounding section, the signal feed-in section including a signal pad electrically connected to the positive end signal lead of the signal feeding line, and the grounding section including a fixing pad for fixing the negative end signal lead of the signal feeding line to the grounding section; and a connection device, one end thereof being connected to the signal pad of the microwave base plate, while the other end thereof being connected to the major conductor for transmitting the high frequency signal to the major conductor and the first housing connected thereto, and further to the torque device connected to the major conductor for forming an antenna loop together with the first vice conductor and the second housing connected thereto.

According to the objectives above, the present invention provides a foldable electronic device, comprising at least a rotating mechanism, a first housing and a second housing, the rotating mechanism including an accommodating space and a two-shaft hinge antenna disposed in the accommodating space, the rotating mechanism enabling the first housing to be rotatable with respect to the second housing, wherein the two-shaft hinge antenna comprises a major conductor connected to the first housing and provided with opposing stretching arms on both sides thereof, an insertion hole being provided on an end of the stretching arm on a side of the major conductor; a first rotating element configured to be mounted to the insertion hole of the stretching arm on a side of the major conductor, wherein the first rotating element comprises a first vice conductor, a stretching arm on a side thereof is provided with a first fitting hole; a torque device including a rotating shaft and a plurality of fastening elements, wherein one end of the rotating shaft is mounted to the insertion hole with a first fastening element, while the other end thereof penetrates the first fitting hole of the first vice conductor for mounting the first vice conductor to the torque device; and a second rotating element configured to be mounted to the stretching arm on the other side of the major conductor, wherein the second rotating element comprises a signal feeding line configured to transmit a high frequency signal and having a positive end signal lead and a negative end signal lead; a microwave base plate having a signal feed-in section and a grounding section, the signal feed-in section including a signal pad electrically connected to the positive end signal lead of the signal feeding line, and the grounding section including a fixing pad for fixing the negative end signal lead of the signal feeding line to the grounding section; and a connection device, one end thereof being connected to the signal pad of the microwave base plate, while the other end thereof being connected to the major conductor for transmitting the high frequency signal to the major conductor and the first housing connected thereto, and further to the torque device connected to the major conductor for forming an antenna loop together with the first vice conductor and the second housing connected thereto.

With the two-shaft hinge antenna provided by the present invention, the effects of structure stabilization, assembly simplification and appearance unification can be achieved. Furthermore, the manufacturing process can be effectively shortened and the yield can be improved as a result.

DETAILED DESCRIPTION OF THE PREFERRED EMBODIMENTS

The present invention mainly discloses a two-shaft hinge antenna and a foldable electronic device having the two-shaft hinge antenna. The major technique of the present invention is using the structure of a hinge itself as an antenna structure, thereby transmitting high frequency signals to housings (i.e. a first housing and a second housing) of an electronic device. The two-shaft structure of such hinge forms an antenna loop which can raise signal transmitting efficiency, increase the overall radiation area of the antenna, and significantly improve the performance of the antenna. Therefore, there is no need to additionally install a micro scale antenna that may influence the quality of wireless signal transmission and reception, so that the effects of structure stabilization, assembly simplification and appearance unification can be achieved, with no shielding effect of metals presented. Furthermore, the fundamental principles and functions of the antenna of the present invention will be understood by those skilled in the art. Thus, in the following description, only the two-shaft hinge antenna of the present invention and the characteristics of a foldable electronic device having the two-shaft hinge antenna are explained in detail. Furthermore, the following description of exemplary embodiments of the present invention are provided for illustrative purposes only and not for the purpose of limiting the present invention as defined by the appended claims and their equivalents.

Figure 1A:
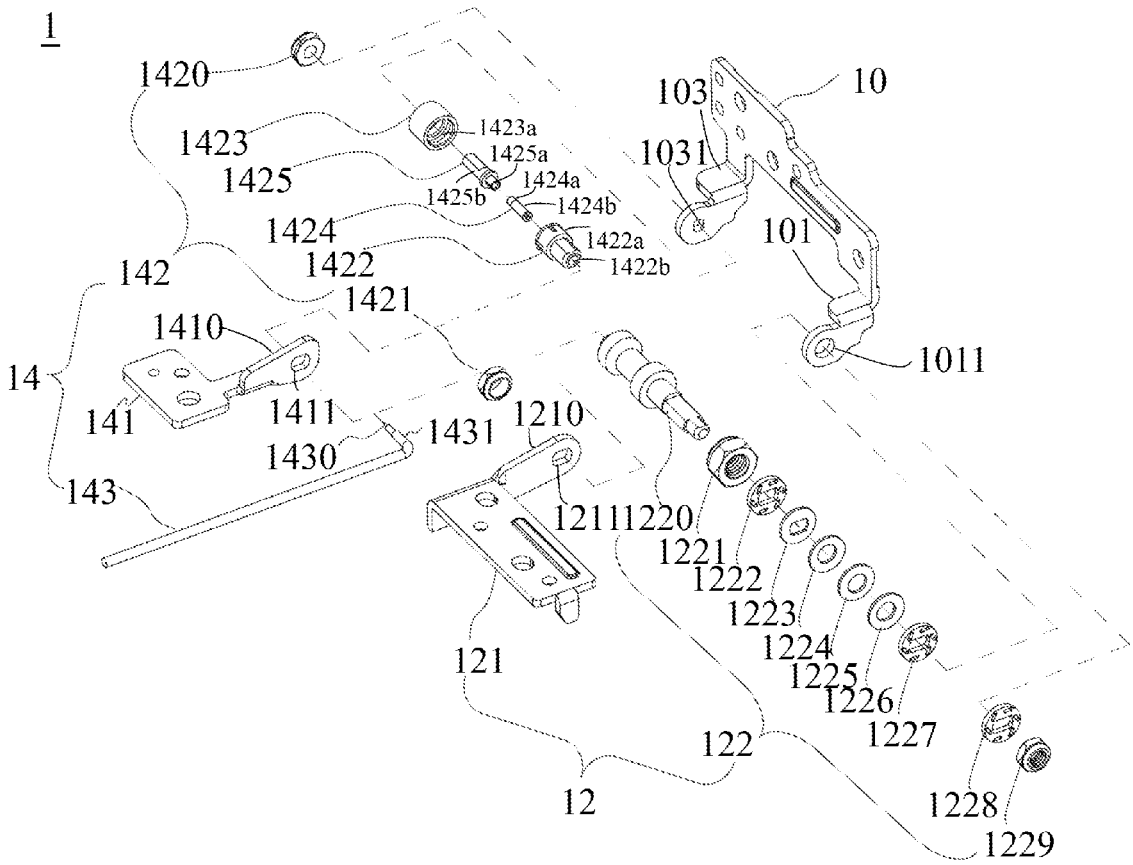
FIG. 1A is an explosive view of a two-shaft hinge antenna according to a first embodiment of the present invention.

First refer to FIG. 1A, which is an explosive view of a two-shaft hinge antenna according to a first embodiment of the present invention. As shown in FIG. 1A, the two-shaft hinge antenna 1 comprises a major conductor 10, a first rotating element 12 and a second rotating element 14, wherein both sides of the major conductor 10 are provided with opposing stretching arms 101 and 103, respectively, the ends of the stretching arms 101 and 103 are provided with a first insertion hole 1011 and a second insertion hole 1031, respectively. The first insertion hole 1011 is configured for the assembling and holding of the first rotating element 12. The first rotating element 12 further includes a first vice conductor 121, of which a stretching arm 1210 is provided with a first fitting hole 1211; and a torque device 122 having a rotation shaft 1220 and a plurality of fastening elements 1221-1229, wherein one end of the rotation shaft 1220 penetrates the plurality of fastening elements 1221-1229, and is assembled to the first insertion hole 1011 with a first fastening element 1229 of the plurality of fastening elements 1221-1229, while the other end of the rotation shaft 1220 penetrates the first fitting hole 1211 of the first vice conductor 121 for mounting the first vice conductor 121 to the torque device 122. With the design of the torque device 122, the first vice conductor 121 is rotatable with respect to the major conductor 10.

Additionally, a second insertion hole 1031 provided on the end of the other stretching arm 103 of the major conductor 10 is configured for the assembling of a second rotating element 14. The second rotating element 14 further includes a second vice conductor 141 having a connection plate 1410 with a second fitting hole 1411 provided thereon; and a connection device 142, wherein one end thereof is assembled to the second insertion hole 1031 with a second fastening element 1420, and the other end thereof penetrates the second fitting hole 1411 of the second vice conductor 141. The second vice conductor 141 is assembled to the connection device 142 with a third fastening element 1421. The connection device 142 has a first coaxial unit 1422, a second coaxial unit 1423, a first coaxial inner conductor 1424 and a second coaxial inner conductor 1425. First, a front end 1425*a* of the second coaxial inner conductor 1425 at a stopping section and an end 1424*a* of the first coaxial inner conductor 1424 are assembled with each other. Then, a rod portion 1424*b* of the first coaxial inner conductor 1424 is inserted into an accommodation recess of the first coaxial unit 1422, and is engaged with an engaging portion 1422*a* of the first coaxial unit 1422 through a thread structure 1423*a* formed on an inner surface of the second coaxial unit 1423, so as to form the connection device 142. After the assembling, a rod portion 1425*b* of the second coaxial inner conductor 1425 can be assembled to the second insertion hole 1031 of the major conductor 10 with the second fastening element 1420. A head portion 1422*b* integrally extending from the engaging portion 1422*a* of the first coaxial unit 1422 may penetrate the second fitting hole 1411 of the second vice conductor 141 for the assembling of the third fastening element 1421. With the design of the connection device 142, the second vice conductor 141 is rotatable with respect to the major conductor 10.

After the assembling of the aforementioned components, the preliminary construction of the second rotating element 14 is accomplished. Further, a signal feeding line 143 is required to penetrate into the connection device 142 for feeding a high frequency signal. The signal feeding line 143 may be coaxial cable having a pair of separated positive end signal lead 1430 (i.e., the inner conductor of the coaxial cable) and negative end signal lead 1431 (i.e., the outside metal shield of the coaxial cable). After the signal feeding line 143 has penetrated into the connection device 142, the positive signal lead 1430 is electrically connected to the first coaxial inner conductor 1424, and the negative end signal lead 1431 of the signal feeding line 143 is electrically connected to the first coaxial unit 1422. Thus, the high frequency signal can be transmitted to the second coaxial inner conductor 1425 via the first coaxial inner conductor 1424, and transmitted to the major conductor 10 via the second coaxial inner conductor 1425, thereby transmitted to the torque device 122 which is connected to the major conductor 10 and forms an antenna loop together with the first vice conductor 121. In this embodiment, since the first coaxial unit has an insulating layer wrapping the first coaxial inner conductor, and the second coaxial unit also has an insulating layer wrapping the second coaxial inner conductor, no electromagnetic interference would not occur between the first coaxial inner conductor and the first coaxial unit or between the second coaxial inner conductor and the second coaxial unit as the high frequency signal is transmitted in the positive end signal lead 1430. As mentioned above, according to the present invention, the high frequency signal can be transmitted to internal circuits (such as internal circuits of the foldable electronic device) through the positive end signal lead 1430 of the signal feeding line 143. The negative end signal lead 1431 of the signal feeding line 143 is connected to components connected to an external housing (e.g. the housing of the foldable electronic device) such as the first coaxial unit 1422, the second coaxial unit 1423, the major conductor 10, the first vice conductor 121, the second vice conductor 141 and the torque device 122, so as to form a common ground. An antenna loop is formed with the aforementioned structure. The work bandwidths of the antenna loop in this embodiment have been matched when the high frequency signal is fed through the signal feeding line 143. As a result, the two-shaft hinge antenna 1 in this embodiment can be applied to one of the third generation of mobile communication (3G) systems, Bluetooth systems and wireless broadband (Wi-Fi) systems. Also, a plurality of through holes formed on the major conductor 10, the first vice conductor 121 and the second vice conductor 141 are configured for the fastening to the external housing (e.g. the housing of the foldable electronic device). Because the major conductor 10, the first vice conductor 121 and the second vice conductor 141 are formed from punch-pressed metal plates, the major conductor 10, the first vice conductor 121 and the second vice conductor 141 are not limited in size or shape.

Figure 1B:
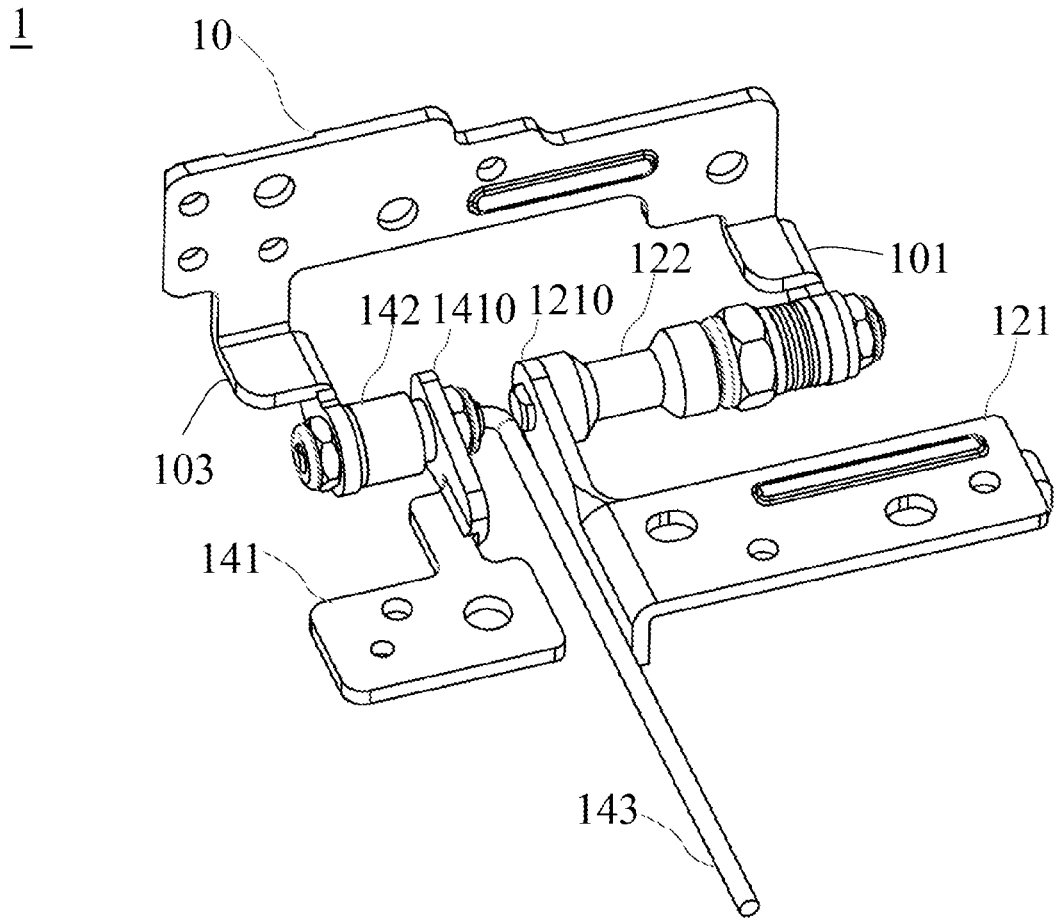
FIG. 1B is an assembled schematic view of the two-shaft hinge antenna according to the first embodiment of the present invention.

Next, please refer to FIG. 1B, which is an assembled schematic view of the two-shaft hinge antenna according to the first embodiment of the present invention. From FIG. 1B, the assembled structure of the aforementioned FIG. 1A can be clearly seen. The first insertion hole, which is provided on the end of the stretching arm 101 on a side of the major conductor 10, is configured to be penetrated by the torque device 122 that is then fastened to the major conductor 10 by the fastening elements. The stretching arm 1210 on a side of the first vice conductor 121 is mounted to the other end of the torque device 122. After finishing the assembling of the abovementioned components, the structure of the first rotating element is constructed. The second insertion hole 1031, which is provided on the end of the stretching arm 103 on the other side of the major conductor 10, is configured to be penetrated by the first coaxial inner conductor (not shown in FIG. 1B) and the second coaxial inner conductor (not shown in FIG. 1B) within the assembled connection device 142 which are then fastened to the major conductor 10 by the fastening elements. Thereafter, the connection plate 1410 of the second vice conductor 141 is mounted to an end of the connection device 142 and fastened by the fastening elements. After finishing the assembling of the abovementioned components, the structure of the second rotating element is constructed. Lastly, the signal feeding line 143 for feeding a high frequency signal is further inserted into the connection device. Thus, the entire structure of the two-shaft hinge antenna 1 is constructed. The two-shaft hinge antenna 1 of the present embodiment is an assembled structure of that illustrated in FIG. 1A, so the detailed structure of the two-shaft hinge antenna 1 will not be described again.

Figure 2:
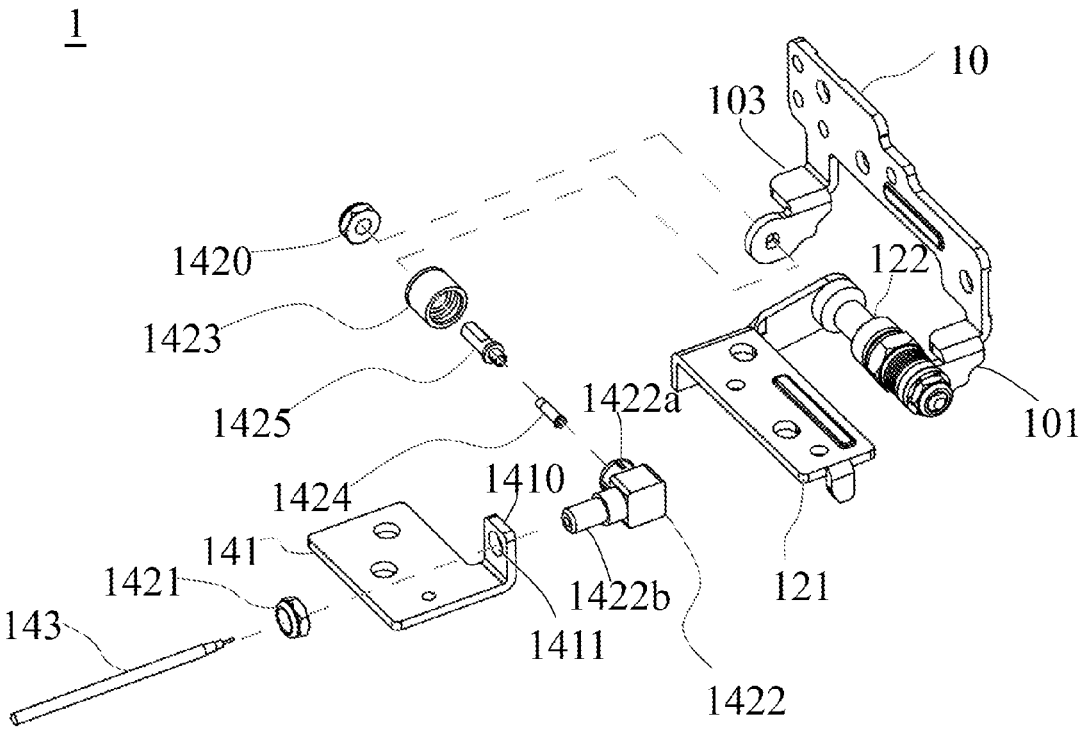
FIG. 2 is another explosive view of the two-shaft hinge antenna according to the first embodiment of the present invention.

Next, please refer to FIG. 2, which is another explosive view of the two-shaft hinge antenna according to the first embodiment of the present invention. The structure shown in FIG. 2 is obviously similar to that of FIG. 1A and thus will not be described in detail. The structure shown in FIG. 2 differs from that of FIG. 1A in the structures of the second vice conductor 141 and first coaxial unit 1422 of the second rotating element. Specifically, the second vice conductor 141 is mainly mounted on the first coaxial unit 1422, so the structure of the second vice conductor 141 is modified only for the structure of the first coaxial unit 1422. The structure of the first coaxial unit 1422 can be referred to that illustrated in FIG. 1A, i.e. the structure of the first coaxial unit 1422 is formed into a convex ring shape by the combination of the engaging portion 1422*a* and the integrally extended head portion 1422*b*. However, as shown in FIG. 2, although the structure of the first coaxial unit 1422 is formed by the combination of the engaging portion 1422*a* and the integrally extended head portion 1422*b*, the shaped thereof is designed to be L-shaped. Since the first coaxial unit 1422 is main configured to be penetrated by the signal feeding line 143, with the L-shaped design of the first coaxial unit 1422 according to the present embodiment, the signal feeding line 143 can penetrate the first coaxial unit 1422 without being formed into a bent shape. Compared to the convex ring design of the first coaxial unit 1422 in FIG. 1A, the present embodiment enables users to operate with greater convenience.

Figure 3A:
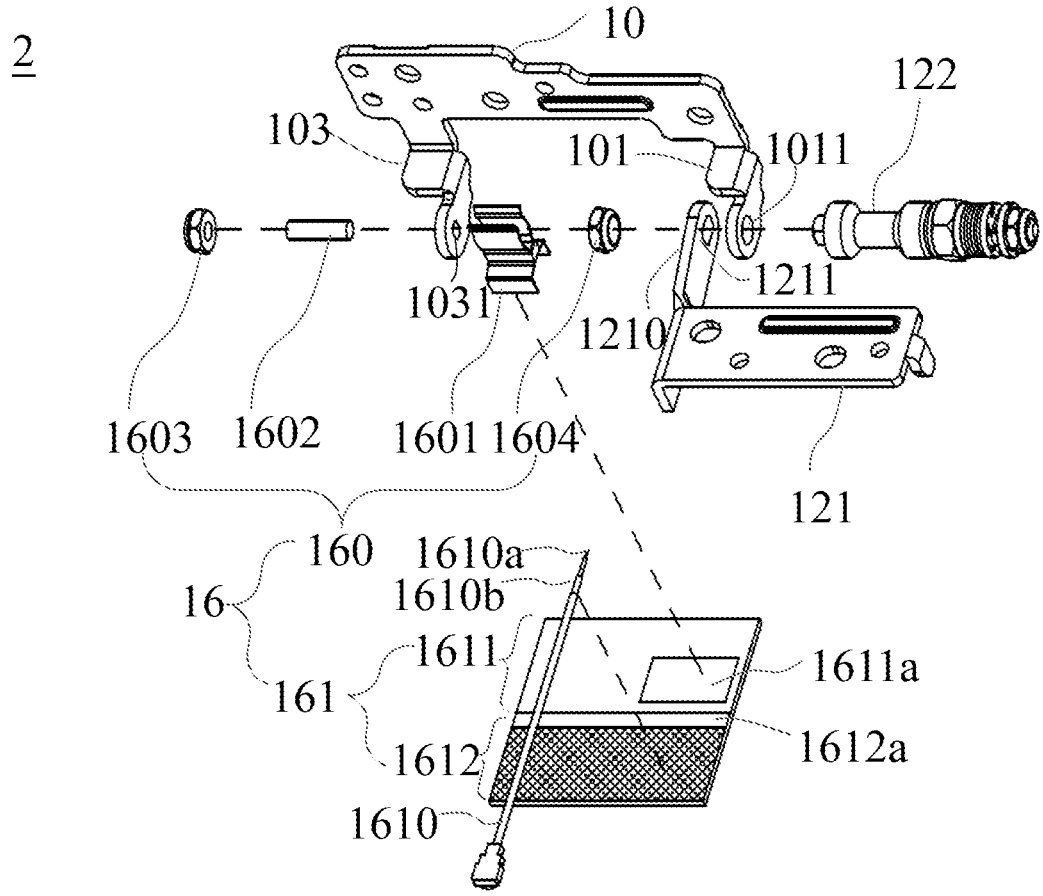
FIG. 3A is an explosive view of a two-shaft hinge antenna according to a second embodiment of the present invention.

Next, please refer to FIG. 3A, which is an explosive view of a two-shaft hinge antenna according to a second embodiment of the present invention. As shown in FIG. 3A, the two-shaft hinge antenna 2 comprises a major conductor 10, a first rotating element 12 and a second rotating element 16, wherein both sides of the major conductor 10 are provided with opposing stretching arms 101 and 103, respectively, the ends of the stretching arms 101 and 103 are provided with a first insertion hole 1011 and a second insertion hole 1031, respectively. The first insertion hole 1011 is configured for the assembling and holding of the first rotating element 12. The first rotating element 12 further includes a first vice conductor 121 and a torque device 122. With the design of the torque device 122, the first vice conductor 121 is rotatable with respect to the major conductor 10. The structures and assembling manner of the first vice conductor 121 and torque device 122 are identical to those of the aforementioned first embodiment, so the detailed description thereof would not be made. A second insertion hole 1031 provided on the end of the other stretching arm 103 of the major conductor 10 is configured for the assembling of a second rotating element 16. The second rotating element 16 further comprises a signal feeding line 1610 for transmitting a high frequency signal; a positive end signal lead 1610*a* and a negative end signal lead 1610*b*; and a microwave base plate 161 having a signal feed-in section 1611 and a grounding section 1612, wherein the signal feed-in section 1611 can be electrically connected to the positive end signal lead 1610*a* of the signal feeding line 1610, and the grounding section 1612 includes a fixing pad 1612*a* for fixing the negative end signal lead 1610*b* of the signal feeding line 1610 to the grounding section 1612.

Moreover, the two-shaft hinge antenna 2 also comprises a connection device 160 having a metal clip 1601 and a rotating member 1602, wherein one end of the rotating member 1602 is fastened to the second insertion hole 1031 of the major conductor 10 by the second fastening element 1603 and the third fastening element 1604, while the other end thereof is held by the metal clip 1601. With the combination of the metal clip 1601 and the rotating member 1602, the connection device 160 is accomplished. Further, the metal clip 1601 of the connection device 160 needs to be connected to a signal pad 1611*a* of the microwave base plate 161. Since the signal pad 1611*a* is electrically connected to the positive end signal lead 1610*a* of the signal feeding line 1610, the high frequency signal can be transmitted to the rotating member 1602 via the metal clip 1601, and further transmitted to the major conductor and the torque device 122 connected thereto for forming an antenna loop with the first vice conductor 121. In a preferred embodiment of the present invention, the signal feeding line 1610 can be a coaxial cable having a separated pair of the positive end signal lead 1610*a* and the negative end signal lead 1610*b*. The positive end signal lead 1610*a* of the signal feeding line 1610 will be electrically connected to the signal pad 1611*a*, while the negative end signal lead 1610*b* of the signal feeding line 1610 is connected to the microwave base plate 161 through the fixing pad 1612*a* (as a connection to ground), so as to prevent the positive end signal lead 1610*a* from short-circuiting due to the radiation interference of the microwave base plate 161, thus the high frequency signal can be received or sent. Since the microwave base plate 161 of the present embodiment is connected to an outer housing (e.g. the housing of the foldable electronic device), after the negative end signal lead 1610*b* of the signal feeding line 1610 is connected to the microwave base plate 161 (as a connection to ground) through the fixing pad 1612*a*, components connected to the outer housing (e.g. the housing of the foldable electronic device), such as the major conductor 10, the first vice conductor 121 and the torque device 122, are integrally connected to form a common ground. An antenna loop is formed with the aforementioned structure.

In addition, in a preferred embodiment of the present invention, the abovementioned microwave base plate 161 can be a printed circuit board (PCB), the signal feed-in section 1611 thereon includes the signal pad 1611*a* capable of optionally forming a matching circuit. Such matching circuit can be an LC circuit formed with inductors and capacitors. Therefore, by adjusting the impedance design of the LC circuit, the high frequency signal to be matched can be selected or adjusted. In accordance with the description above, in the present invention, a desired operational bandwidth may be further adjusted by the matching circuit and then fed to the positive end signal lead 1610*a* of the signal feeding line 1610 for transmitting a high frequency signal to an internal circuit (such as an internal circuit of the foldable electronic device). Alternatively, the high frequency signal emitted from the internal circuit (such as an internal circuit of the foldable electronic device) is transmitted through the matching circuit for adjusting to a desired operational bandwidth and to the internal circuit (such as an internal circuit of the foldable electronic device) again via the positive end signal lead 1610*a* of the signal feeding line 1610. It should be noted that, in the present embodiment, the matching circuit is adapted to adjust the working bandwidth of the antenna loop. Therefore, the two-shaft hinge antenna 2 of the present embodiment can be applied to one of the third generation of mobile communication (3G) systems, Bluetooth systems and wireless broadband (Wi-Fi) systems. Also, a plurality of through holes formed on the major conductor 10, the first vice conductor 121 and the second vice conductor 141 are configured for the fastening to the external housing (e.g. the housing of the foldable electronic device).

Figure 3B:
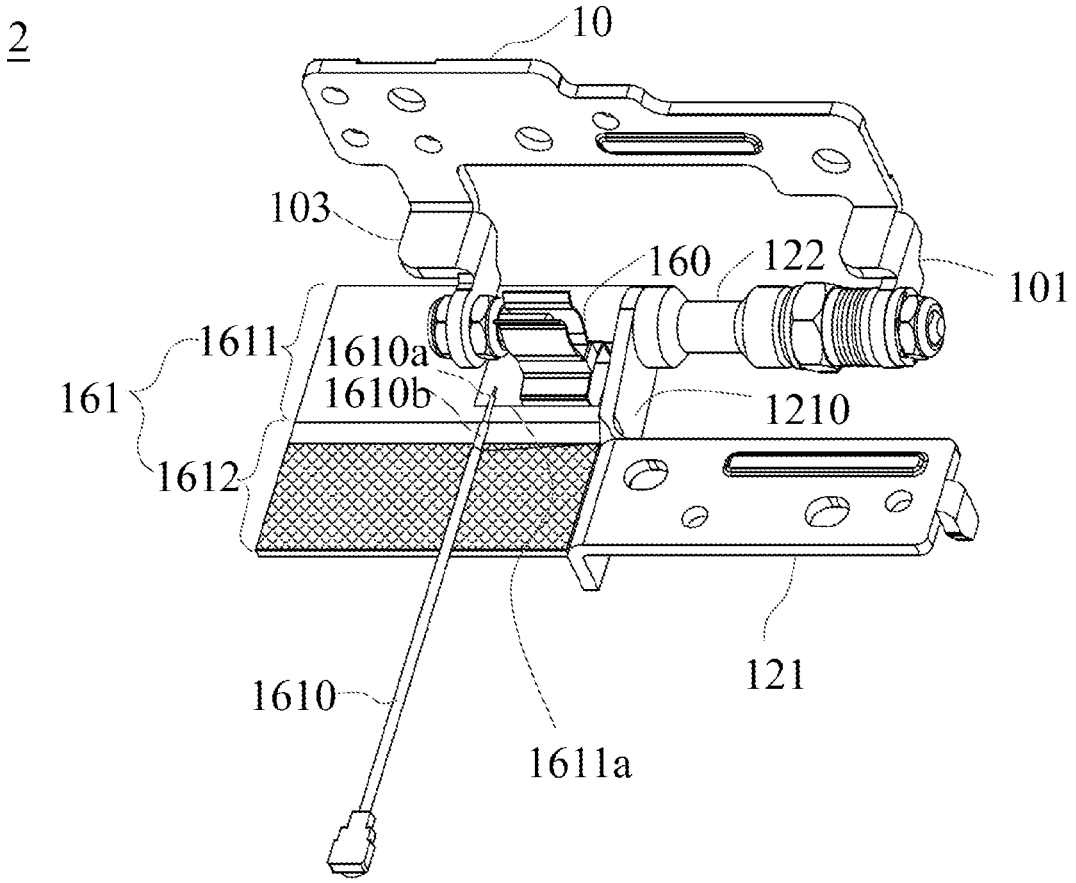
FIG. 3B is an assembled schematic view of the two-shaft hinge antenna according to the second embodiment of the present invention.

Next, please refer to FIG. 3B, which is an assembled schematic view of the two-shaft hinge antenna according to the second embodiment of the present invention. From FIG. 3B, the assembled structure of the aforementioned FIG. 1A can be clearly seen. The first insertion hole, which is provided on the end of the stretching arm 101 on a side of the major conductor 10, is configured to be penetrated by the torque device 122 that is then fastened to the major conductor 10 by the fastening elements. The stretching arm 1210 on a side of the first vice conductor 121 is mounted to the other end of the torque device 122. After finishing the assembling of the abovementioned components, the structure of the first rotating element is constructed. The second insertion hole 1031, which is provided on the end of the stretching arm 103 on the other side of the major conductor 10, is configured to be penetrated by the rotating member 1602 of the connection device 160 which is then fastened to the major conductor 10 by the fastening elements. Thereafter, the rotating member 1602 is held by the metal clip 1601. After finishing the assembling of the metal clip 1601 and the rotating member 1602, the structure of the connection device 160 is constructed. Further, one end of the metal clip 1601 of the connection device 160 needs to be connected to a signal pad 1611*a* of the microwave base plate 161. Since the signal pad 1611*a* is electrically connected to the positive end signal lead 1610*a* of the signal feeding line 1610, the high frequency signal can be transmitted to the rotating member 1602 via the metal clip 1601, and further transmitted to the major conductor 10 and the torque device 122 connected thereto for forming an antenna loop with the first vice conductor 121. Thus, the entire structure of the two-shaft hinge antenna 2 is constructed. The two-shaft hinge antenna 2 of the present embodiment is an assembled structure of that illustrated in FIG. 3A, so the detailed structure of the two-shaft hinge antenna 2 will not be described again.

Figure 4A:
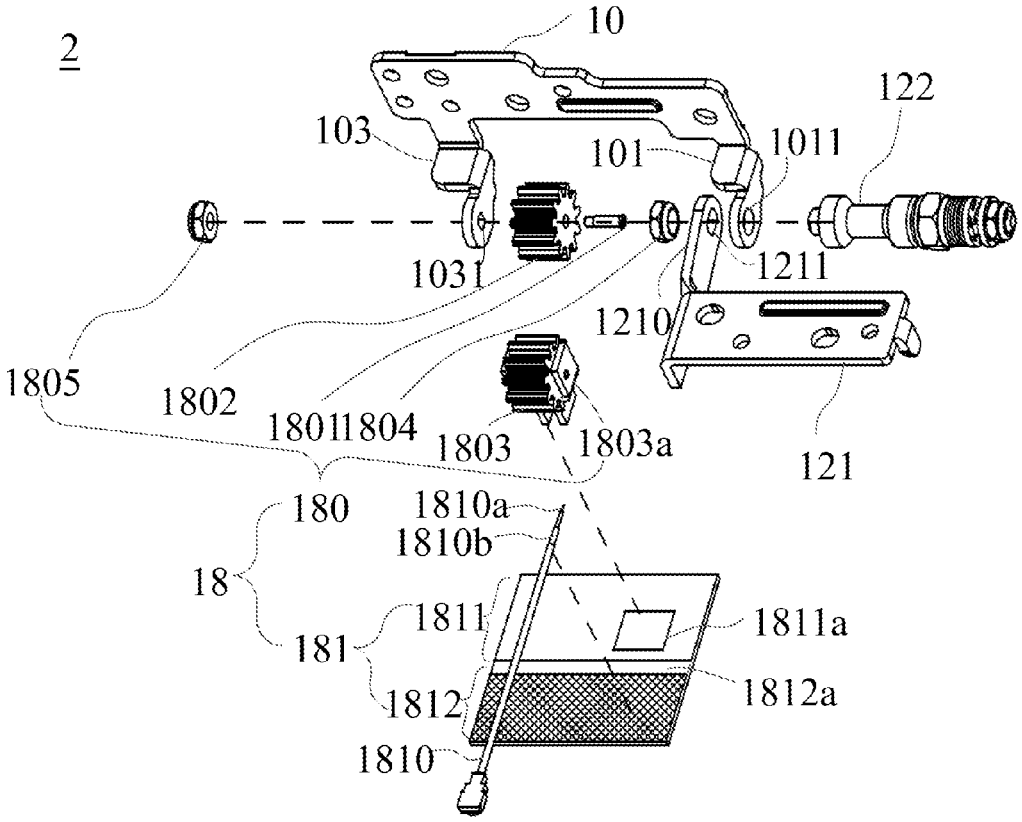
FIG. 4A is another explosive view of the two-shaft hinge antenna according to the second embodiment of the present invention.

Next, please refer to FIG. 4A, which is another explosive view of the two-shaft hinge antenna according to the second embodiment of the present invention. The structure shown in FIG. 4A is obviously similar to that of FIG. 3A and thus will not be described in detail. The structure shown in FIG. 4A differs from that of FIG. 3A in that the second insertion hole 1031, which is provided on the end of the stretching arm 103 on one side of the major conductor 10, is configured for the mounting of a second rotating element 18. The second rotating element 18 further comprises a signal feeding line 1810 configured for transmitting a high frequency signal and having a positive end signal lead 1810*a* and a negative end signal lead 1810*b*; and a microwave base plate 181 having a signal feed-in section 1811 and a grounding section 1812, wherein the signal feed-in section 1811 includes a signal pad 1811*a* which can be electrically connected to the positive end signal lead 1810*a* of the signal feeding line 1810, and the grounding section 1812 includes a fixing pad 1812*a* for fixing the negative end signal lead 1810*b* of the signal feeding line 1810 to the grounding section 1812.

The two-shaft hinge antenna 2 further comprises a connection device 180 including a rotating member 1801*a* first gear 1802, a second gear 1803 and a fixing member 1803*a* for securing the second gear 1803, wherein the rotating member 1801 penetrates the first gear 1802, and is fastened to the second insertion hole 1031 of the major conductor 10 by a second fastening element 1084 and a third fastening element 1805. After the second gear 1803 and the fixing member 1803*a* are assembled, the second gear 1803 would engage the first gear 1802, accomplishing the connection device 180. Further, one end of the fixing member 1801 of the connection device 180 needs to be connected to the signal pad 1811*a* of the microwave base plate 181. Since the signal pad 1811*a* is electrically connected to the positive end signal lead 1810*a* of the signal feeding line 1810, the high frequency signal can be transmitted to the engaged second gear 1803 and first gear 1802 via the fixing member 1803*a*, and further transmitted to the major conductor 10 and the torque device 122 connected thereto for forming an antenna loop with the first vice conductor 121. Similarly, in a preferred embodiment of the present invention, the signal feeding line 1810 can be a coaxial cable including a separated pair of the positive end signal lead 1810*a* and the negative end signal lead 1810*b*. The positive end signal lead 1810*a* of the signal feeding line 1810 is electrically connected to the signal pad 1811*a*, while the negative end signal lead 1810*b* of the signal feeding line 1810 is connected to the microwave base plate 181 through a fixing pad 1812*a* (as a connection to ground), so as to prevent the positive end signal lead 1810*a* from short-circuiting due to the radiation interference of the microwave base plate 181, thus the high frequency signal can be received or sent. Since the microwave base plate 181 of the present embodiment is connected to an outer housing (e.g. the housing of the foldable electronic device), after the negative end signal lead 1810*b* of the signal feeding line 1810 is connected to the microwave base plate 181 (as a connection to ground) through the fixing pad 1812*a*, components connected to the outer housing (e.g. the housing of the foldable electronic device), such as the major conductor 10, the first vice conductor 121 and the torque device 122, are integrally connected to form a common ground. An antenna loop is formed with the aforementioned structure.

In addition, the abovementioned microwave base plate 181 can be a printed circuit board (PCB), the signal feed-in section 1811 thereon includes the signal pad 1811*a* capable of optionally forming a matching circuit. Such matching circuit can be an LC circuit formed with inductors and capacitors. Therefore, by adjusting the impedance design of the LC circuit, the high frequency signal to be matched can be selected or adjusted. In accordance with the description above, in the present invention, a desired operational bandwidth may be further adjusted by the matching circuit and then fed to the positive end signal lead 1810*a* of the signal feeding line 1810 for transmitting a high frequency signal to an internal circuit (such as an internal circuit of the foldable electronic device). Alternatively, the high frequency signal emitted from the internal circuit (such as an internal circuit of the foldable electronic device) is transmitted through the matching circuit for adjusting to a desired operational bandwidth and to the internal circuit (such as an internal circuit of the foldable electronic device) again via the positive end signal lead 1810*a* of the signal feeding line 1810. It should be noted that, in the present embodiment, the matching circuit is adapted to adjust the working bandwidth of the antenna loop. Therefore, the two-shaft hinge antenna 2 of the present embodiment can be applied to one of the third generation of mobile communication (3G) systems, Bluetooth systems and wireless broadband (Wi-Fi) systems. Also, a plurality of through holes formed on the major conductor 10 and the first vice conductor 121 are configured for the fastening to the external housing (e.g. the housing of the foldable electronic device).

Figure 4B:
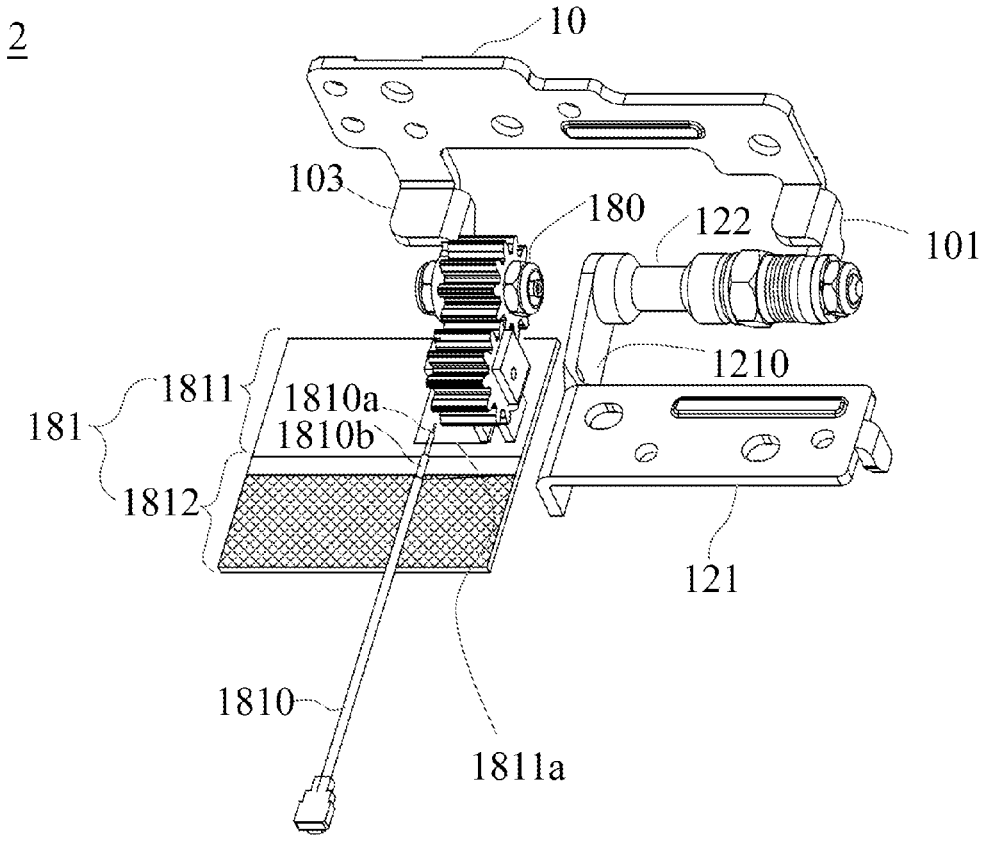
FIG. 4B is another assembled schematic view of the two-shaft hinge antenna according to the second embodiment of the present invention.

Next, please refer to FIG. 4B, which is another assembled schematic view of the two-shaft hinge antenna according to the second embodiment of the present invention. From FIG. 4B, the assembled structure of the aforementioned FIG. 4A can be clearly seen. The first insertion hole, which is provided on the end of the stretching arm 101 on a side of the major conductor 10, is configured to be penetrated by the torque device 122 that is then fastened to the major conductor 10 by the fastening elements. The stretching arm 1210 on a side of the first vice conductor 121 is mounted to the other end of the torque device 122. After finishing the assembling of the abovementioned components, the structure of the first rotating element is constructed. The second insertion hole 1031, which is provided on the end of the stretching arm 103 on the other side of the major conductor 10, is configured to be penetrated by the rotating member 1801 of the connection device 180 which penetrates the first gear 1802 and is then fastened to the major conductor 10 by the fastening elements. Thereafter, the second gear 1803 and the fixing member 1803*a* are assembled, then the second gear 1803 would engage the first gear 1802, and the connection device 180 is constructed. Further, one end of the fixing member 1803*a* of the connection device 180 needs to be connected to the signal pad 1811*a* of the microwave base plate 181. Since the signal pad 1811*a* is electrically connected to the positive end signal lead 1810*a* of the signal feeding line 1810, the high frequency signal can be transmitted to the engaging second gear 1803 and first gear 1802 via the fixing member 1803*a*, and further transmitted to the major conductor 10 and the torque device 122 connected thereto for forming an antenna loop with the first vice conductor 121. Thus, the entire structure of the two-shaft hinge antenna 2 is constructed. The two-shaft hinge antenna 2 of the present embodiment is an assembled structure of that illustrated in FIG. 4A, so the detailed structure of the two-shaft hinge antenna 2 will not be described again.

Figure 5A:
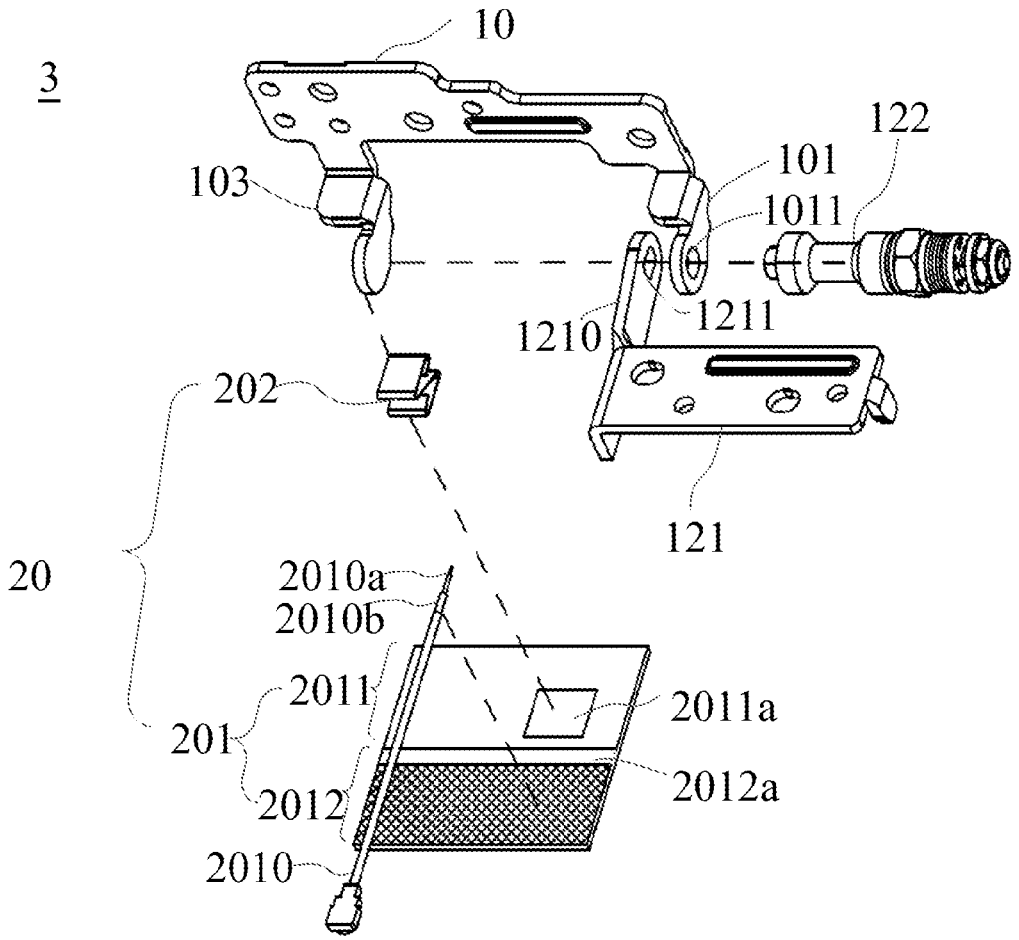
FIG. 5A is an explosive view of a two-shaft hinge antenna according to a third embodiment of the present invention.

Next, please refer to FIG. 5A, which is an explosive view of the two-shaft hinge antenna according to the third embodiment of the present invention. The structure shown in FIG. 5A is obviously similar to those of FIG. 3A or 4A and thus will not be described in detail. The structure shown in FIG. 5A differs from those of FIG. 3A or 4A in that the second insertion hole 1031, which is provided on the end of the stretching arm 103 on one side of the major conductor 10, is configured for the mounting of a second rotating element 20. The second rotating element 20 further comprises a signal feeding line 2010 configured for transmitting a high frequency signal and having a positive end signal lead 2010*a* and a negative end signal lead 2010*b*; and a microwave base plate 201 having a signal feed-in section 2011 and a grounding section 2012, wherein the signal feed-in section 2011 includes a signal pad 2011*a* which can be electrically connected to the positive end signal lead 2010*a* of the signal feeding line 2010, and the grounding section 2012 includes a fixing pad 2012*a* for fixing the negative end signal lead 2010*b* of the signal feeding line 2010 to the grounding section 2012.

Moreover, the two-shaft hinge antenna 3 also comprises a connection device which is a metal spring sheet 202 with a geometric shape. As one end of the metal spring sheet 202 is mounted to an end of the stretching arm on a side of the major conductor 10, the other end thereof further needs to be connected to the signal pad 2011*a* of the microwave base plate 201. Since the signal pad 2011*a* is electrically connected to the positive end signal lead 2010*a* of the signal feeding line 2010, the high frequency signal can be transmitted to the major conductor and the torque device 122 connected thereto, via the metal spring sheet 202, for forming an antenna loop with the first vice conductor 121. Similarly, in a preferred embodiment of the present invention, the signal feeding line 2010 can be a coaxial cable having a separated pair of the positive end signal lead 2010*a* and the negative end signal lead 2010*b*. The positive end signal lead 2010*a* of the signal feeding line 2010 will be electrically connected to the signal pad 2011*a*, while the negative end signal lead 2010*b* of the signal feeding line 2010 is connected to the microwave base plate 201 through the fixing pad 2012*a* (as a connection to ground), so as to prevent the positive end signal lead 2010*a* from short-circuiting due to the radiation interference of the microwave base plate 201, thus the high frequency signal can be received or sent. Since the microwave base plate 201 of the present embodiment is connected to an outer housing (e.g. the housing of the foldable electronic device), after the negative end signal lead 2010*b* of the signal feeding line 2010 is connected to the microwave base plate 201 (as a connection to ground) through the fixing pad 2012*a*, components connected to the outer housing (e.g. the housing of the foldable electronic device), such as the major conductor 10, the first vice conductor 121 and the torque device 122, are integrally connected to form a common ground. An antenna loop is formed with the aforementioned structure.

In addition, the abovementioned microwave base plate 201 can be a printed circuit board (PCB), the signal feed-in section 2011 thereon includes the signal pad 2011*a* capable of optionally forming a matching circuit. Such matching circuit can be an LC circuit formed with inductors and capacitors. Therefore, by adjusting the impedance design of the LC circuit, the high frequency signal to be matched can be selected or adjusted. In accordance with the description above, in the present invention, a desired operational bandwidth may be further adjusted by the matching circuit and then fed to the positive end signal lead 2010*a* of the signal feeding line 2010 for transmitting a high frequency signal to an internal circuit (such as an internal circuit of the foldable electronic device). Alternatively, the high frequency signal emitted from the internal circuit (such as an internal circuit of the foldable electronic device) is transmitted through the matching circuit for adjusting to a desired operational bandwidth and to the internal circuit (such as an internal circuit of the foldable electronic device) again via the positive end signal lead 2010*a* of the signal feeding line 2010. It should be noted that, in the present embodiment, the matching circuit is adapted to adjust the working bandwidth of the antenna loop. Therefore, the two-shaft hinge antenna 3 of the present embodiment can be applied to one of the third generation of mobile communication (3G) systems, Bluetooth systems and wireless broadband (Wi-Fi) systems. Also, a plurality of through holes formed on the major conductor 10 and the first vice conductor 121 are configured for the fastening to the external housing (e.g. the housing of the foldable electronic device).

Figure 5B:
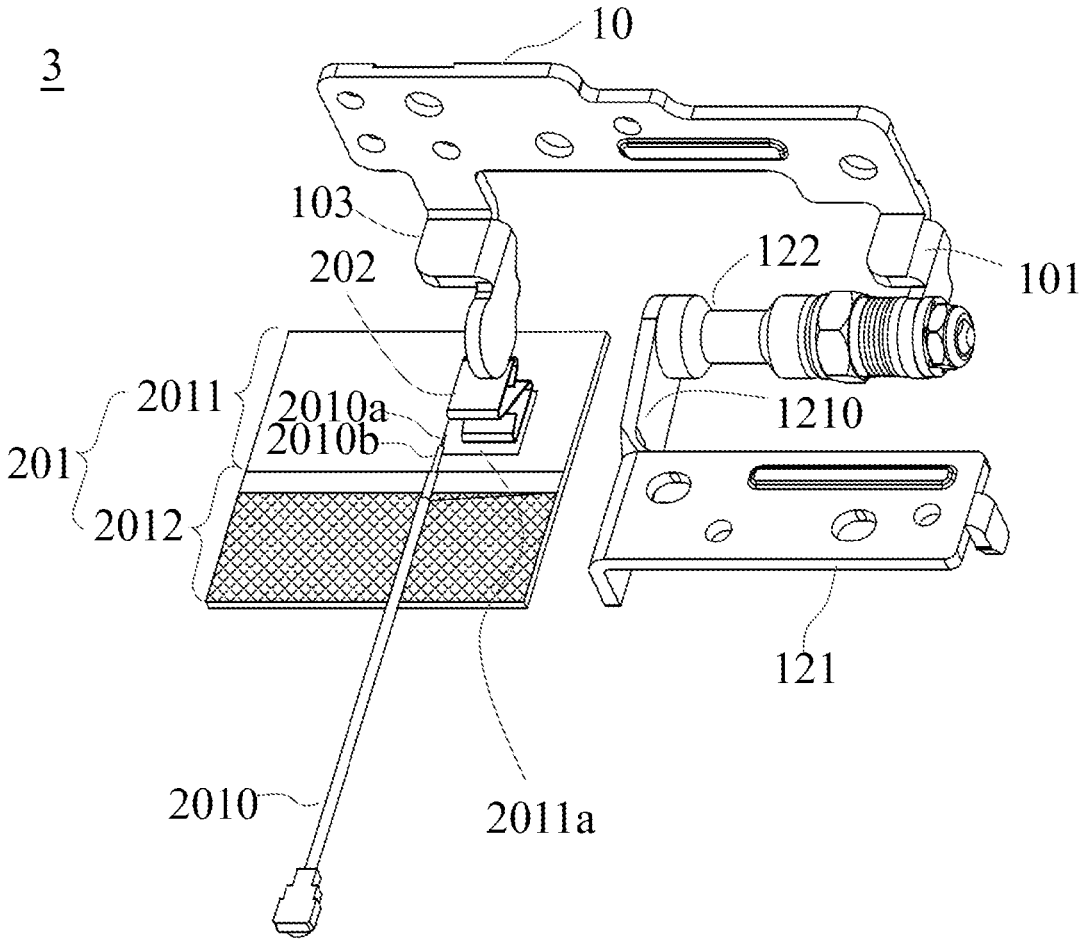
FIG. 5B is an assembled schematic view of the two-shaft hinge antenna according to the third embodiment of the present invention.

Next, please refer to FIG. 5B, which is another assembled schematic view of the two-shaft hinge antenna according to the third embodiment of the present invention. From FIG. 5B, the assembled structure of the aforementioned FIG. 5A can be clearly seen. The first insertion hole, which is provided on the end of the stretching arm 101 on a side of the major conductor 10, is configured to be penetrated by the torque device 122 that is then fastened to the major conductor 10 by the fastening elements. The stretching arm 1210 on a side of the first vice conductor 121 is mounted to the other end of the torque device 122. After finishing the assembling of the abovementioned components, the structure of the first rotating element is constructed. The stretching arm 103 on the other side of the major conductor 10 is configured for the direct connection of the connection device, that is, the metal spring sheet 202. Further, the other end of the metal spring sheet 202 needs to be connected to the signal pad 2011*a* of the microwave base plate 201. Since the signal pad 2011*a* is electrically connected to the positive end signal lead 2010*a* of the signal feeding line 2010, the high frequency signal can be transmitted, via the metal spring sheet 202, to the major conductor 10 and the torque device 122 connected thereto for forming an antenna loop with the first vice conductor 121. Thus, the entire structure of the two-shaft hinge antenna 3 is constructed. The two-shaft hinge antenna 3 of the present embodiment is an assembled structure of that illustrated in FIG. 5A, so the detailed structure of the two-shaft hinge antenna 3 will not be described again.

Figure 6A:
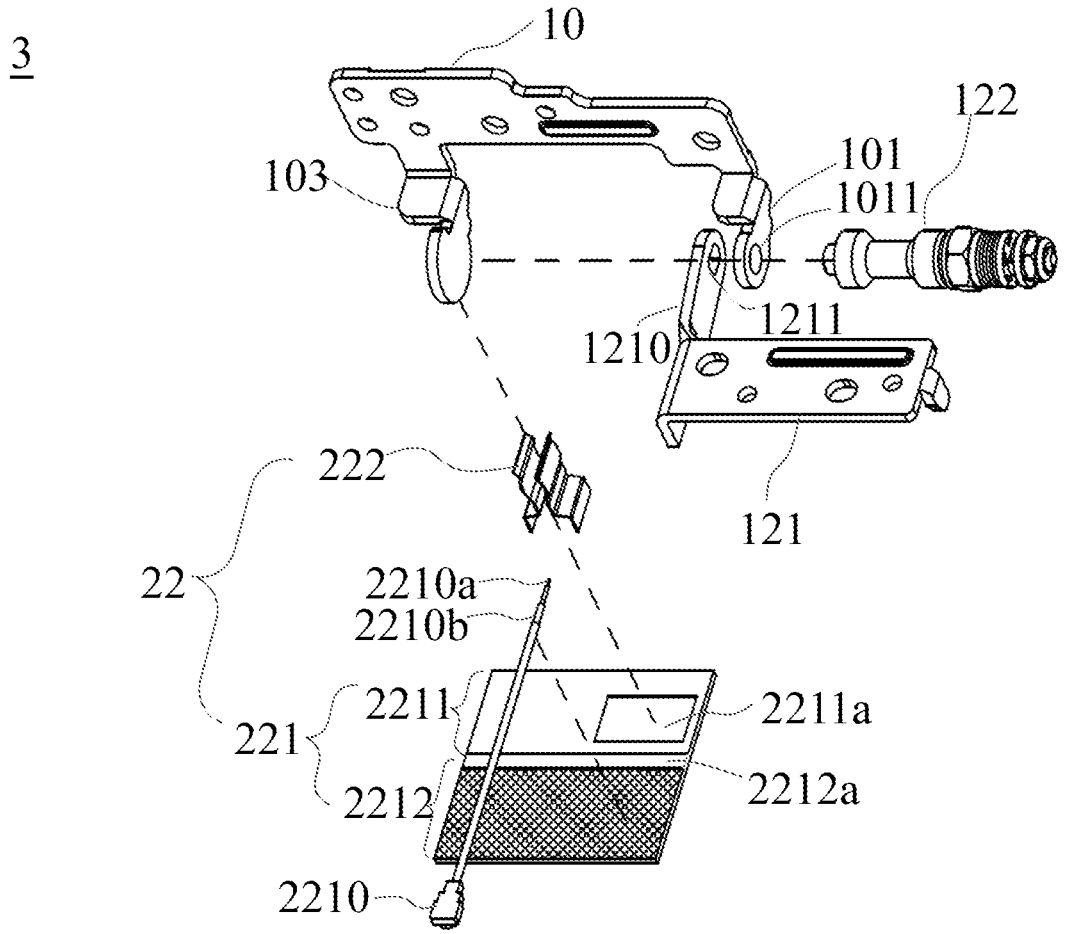
FIG. 6A is another explosive view of the two-shaft hinge antenna according to the third embodiment of the present invention.

Next, please refer to FIG. 6A, which is another explosive view of the two-shaft hinge antenna according to the third embodiment of the present invention. The structure shown in FIG. 6A is obviously similar to that of FIG. 5A and thus will not be described in detail. The structure shown in FIG. 6A differs from that of FIG. 5A in the second rotating element 22 connected to the stretching arm 103 on one side of the major conductor 10. The second rotating element 22 further comprises a signal feeding line 2210 configured for transmitting a high frequency signal and having a positive end signal lead 2210*a* and a negative end signal lead 2210*b*; and a microwave base plate 221 having a signal feed-in section 2211 and a grounding section 2212, wherein the signal feed-in section 2211 includes a signal pad 2211*a* which can be electrically connected to the positive end signal lead 2210*a* of the signal feeding line 2210, and the grounding section 2212 includes a fixing pad 2212*a* for fixing the negative end signal lead 2210*b* of the signal feeding line 2210 to the grounding section 2212.

Moreover, the two-shaft hinge antenna 3 also comprises a connection device which is a metal clip 222. After one end of the metal clip 222 holds the stretching arm on a side of the major conductor 10, the other end thereof further needs to be connected to the signal pad 2211*a* of the microwave base plate 221. Since the signal pad 2211*a* is electrically connected to the positive end signal lead 2210*a* of the signal feeding line 2210, the high frequency signal can be transmitted to the major conductor and the torque device 122 connected thereto, via the metal clip 222, for forming an antenna loop with the first vice conductor 121. Similarly, in a preferred embodiment of the present invention, the signal feeding line 2210 can be a coaxial cable having a separated pair of the positive end signal lead 2210*a* and the negative end signal lead 2210*b*. The positive end signal lead 2210*a* of the signal feeding line 2210 will be electrically connected to the signal pad 2211*a*, while the negative end signal lead 2210*b* of the signal feeding line 2210 is connected to the microwave base plate 221 through the fixing pad 2212*a* (as a connection to ground), so as to prevent the positive end signal lead 2210*a* from short-circuiting due to the radiation interference of the microwave base plate 221, thus the high frequency signal can be received or sent. Since the microwave base plate 221 of the present embodiment is connected to an outer housing (e.g. the housing of the foldable electronic device), after the negative end signal lead 2210*b* of the signal feeding line 2210 is connected to the microwave base plate 221 (as a connection to ground) through the fixing pad 2212*a*, components connected to the outer housing (e.g.

the housing of the foldable electronic device), such as the major conductor 10, the first vice conductor 121 and the torque device 122, are integrally electrically connected to form a common ground. An antenna loop is formed with the aforementioned structure.

In addition, as mentioned above, the microwave base plate 201 can be a printed circuit board (PCB), a signal feed-in section 2211 thereon includes the signal pad 2211*a* capable of optionally forming a matching circuit. Such matching circuit can be an LC circuit formed with inductors and capacitors. Therefore, by adjusting the impedance design of the LC circuit, the high frequency signal to be matched can be selected or adjusted. In accordance with the description above, in the present invention, a desired operational bandwidth may be further adjusted by the matching circuit and then fed to the positive end signal lead 2210*a* of the signal feeding line 2210 for transmitting a high frequency signal to an internal circuit (such as an internal circuit of the foldable electronic device). Alternatively, the high frequency signal emitted from the internal circuit (such as an internal circuit of the foldable electronic device) is transmitted through the matching circuit for adjusting to a desired operational bandwidth and to the internal circuit (such as an internal circuit of the foldable electronic device) again via the positive end signal lead 2210*a* of the signal feeding line 2210. It should be noted that, in the present embodiment, the matching circuit is adapted to adjust the working bandwidth of the antenna loop. Therefore, the two-shaft hinge antenna 3 of the present embodiment can be applied to one of the third generation of mobile communication (3G) systems, Bluetooth systems and wireless broadband (Wi-Fi) systems. Also, a plurality of through holes formed on the major conductor 10 and the first vice conductor 121 are configured for the fastening to the external housing (e.g. the housing of the foldable electronic device).

Figure 6B:
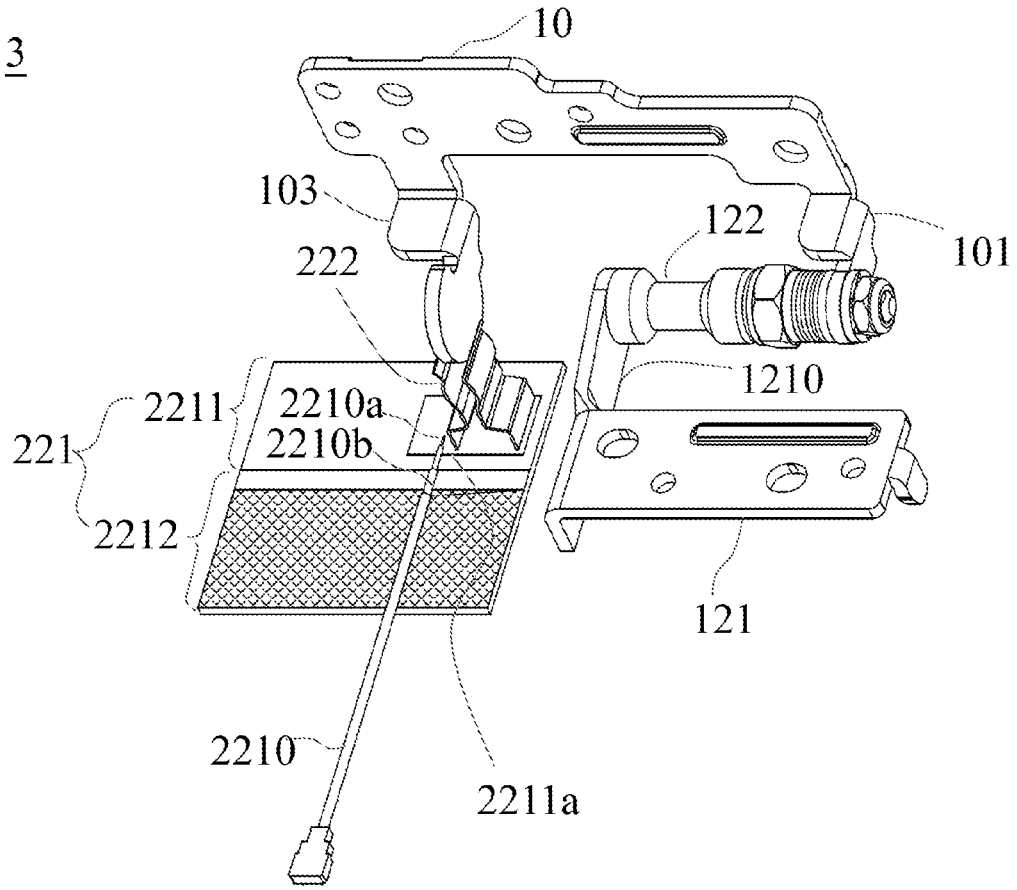
FIG. 6B is another assembled schematic view of the two-shaft hinge antenna according to the third embodiment of the present invention.

Next, please refer to FIG. 6B, which is another assembled schematic view of the two-shaft hinge antenna according to the third embodiment of the present invention. From FIG. 6B, the assembled structure of the aforementioned FIG. 6A can be clearly seen. The first insertion hole, which is provided on the end of the stretching arm 101 on a side of the major conductor 10, is configured to be penetrated by the torque device 122 that is then fastened to the major conductor 10 by the fastening elements. The stretching arm 1210 on a side of the first vice conductor 121 is mounted to the other end of the torque device 122. After finishing the assembling of the abovementioned components, the structure of the first rotating element is constructed. Further, one end of the metal clip 222 needs to be connected to the signal pad 2211*a* of the microwave base plate 221. Since the signal pad 2211*a* is electrically connected to the positive end signal lead 2210*a* of the signal feeding line 2210, the high frequency signal can be transmitted, via the metal clip 222, to the major conductor 10 and the torque device 122 connected thereto for forming an antenna loop with the first vice conductor 121. Thus, the entire structure of the two-shaft hinge antenna 3 is constructed. The two-shaft hinge antenna 3 of the present embodiment is an assembled structure of that illustrated in FIG. 6A, so the detailed structure of the two-shaft hinge antenna 3 will not be described again.

Figure 7:
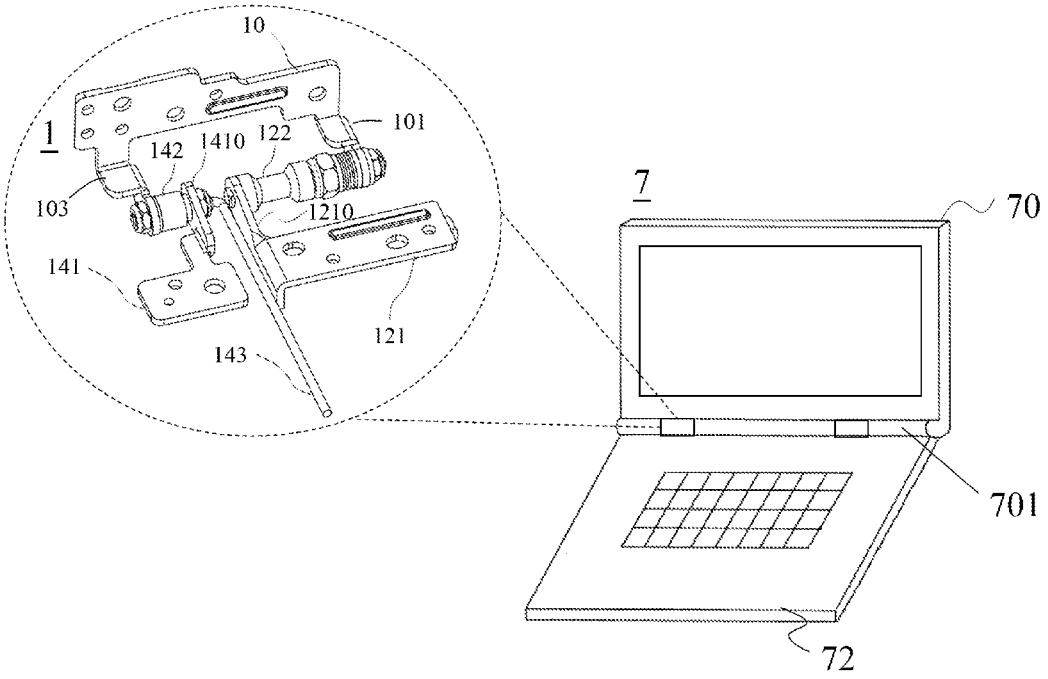
FIG. 7 is a schematic view showing the application of the first embodiment in a foldable electronic device.
Figure 8:
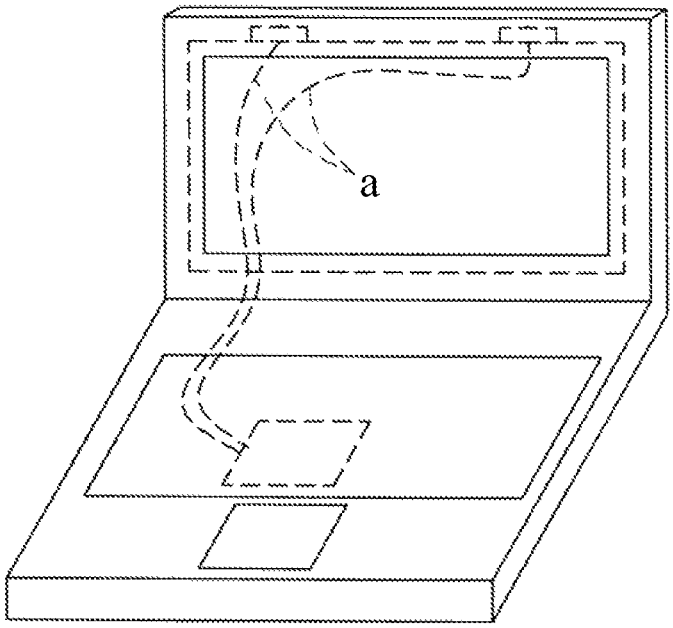
Fig. 8 (Prior Art)
FIG. 8 is a schematic view showing a conventional antenna structure.

Next, please refer to FIG. 7, which is a schematic view showing the application of the first embodiment in a foldable electronic device. As shown in FIG. 7, a foldable electronic device 7 at least comprises a rotating mechanism 701, a first housing 70 and a second housing 72, wherein the first housing 70 and the second housing 72 are integrally connected through the rotating mechanism 701, so that the first housing 70 and the second housing 72 make relative rotational displacement about the rotating mechanism 701. In a preferred embodiment of the present invention, the foldable electronic device 7 is a laptop. Thus, the first housing 70 is a housing accommodating the displaying screen of the laptop, and the second housing 72 is a housing accommodating the keyboard and motherboard of the laptop. The rotating mechanism 701 is provided with an accommodating space for the two-shaft hinge antenna to be disposed therein. Therefore, the present invention is characterized by the integration of a metal bulk antenna and the rotating mechanism 701 for forming the two-shaft hinge antenna 1. As such, the two-shaft hinge antenna 1 formed by incorporating the rotating mechanism 701 may not only provide the torque required in the rotation of the first housing 70 and the second housing 72, but also be formed to have the function of an antenna. The abovementioned two-shaft hinge antenna 1 formed by incorporating the rotating mechanism 701 has the same structure as the two-shaft hinge antenna 1 of the first embodiment (as shown in FIG. 1B), thus the detailed description therefor will not be provided.

In the case that the two-shaft hinge antenna 1 of the first embodiment of the present invention (as shown in FIG. 1B) is disposed in the foldable electronic device 7, in the two-shaft hinge antenna 1, the rotating mechanism 701 is replaced by the torque device 122 and the connection device 142. In addition, connection to the first housing 70 or the second housing 72 can be made through the major conductor 10, the first vice conductor 121 and the second conductor 141 in the two-shaft hinge antenna. It is to be understood that, for the present invention, the material of the first housing 70 or the second housing 72 is not limited. Accordingly, the first housing 70 and the second housing 72 can both be made of metal. Alternatively, one of the first housing 70 and the second housing 72 can be metallic, while the other one may be non-metallic. Furthermore, in the case that one or more pairs of the rotating mechanisms 701 are provided on the foldable electronic device, the two-shaft hinge antenna 1 of the present invention may be selectively provided in one of the rotating mechanisms 701, which is not limited in the present invention, either.

Moreover, because the first coaxial unit 1422, the second coaxial unit 1423, the major conductor 10, the first vice conductor 121, the second vice conductor 141 and the torque device 122 are formed from punch-pressed metal plates, after the major conductor 10, the first vice conductor 121 or the first and second vice conductors 121 and 141 are connected to the first housing 70 or the second housing 72, as the negative end signal lead 1431 of the signal feeding line 143 is connected to the first coaxial unit 1422, it means the negative end signal lead 1431 of the signal feeding line 143 is electrically connected to the first coaxial unit 1422, the second coaxial unit 1423, the major conductor 10, the first vice conductor 121, the second vice conductor 141 and the torque device in a collective manner, forming a common ground. Apparently, the working bandwidth of the antenna loop in the present embodiment has been matched as the signal feeding line 143 feeds the high frequency signal. Therefore, the two-shaft hinge antenna 1 of the present embodiment can be applied to one of the third generation of mobile communication (3G) systems, Bluetooth systems and wireless broadband (Wi-Fi) systems. Also, in the present embodiment, since the hinge structure itself is utilized as an antenna structure, there is no need to additionally install a micro scale antenna. As a result, the circuits can be substantially simplified without affecting the quality of high frequency signal transmission and reception. Thus, the effects of structure stabilization, assembly simplification and appearance unification can be achieved, thereby promoting the product quality.

It should also be noted that the present embodiment is not limited to the two-shaft hinge antenna 1 used in the foldable electronic device 7, and for example, another two-shaft hinge antenna 1 shown in FIG. 2 can be disposed in the foldable electronic device 7. Alternatively, the two-shaft hinge antennas 2 and 3 shown in FIGS. 3B, 4B, 5B, 6B, for example, may be disposed in the foldable electronic device. In addition, according to the structure of the foldable electronic device to be assembled, the design for the connection to the foldable electronic device can be adjusted. Since the two-shaft hinge antennas 1, 2, 3 mentioned herein have been described above, they will not be elaborated again.

Although the present invention has been disclosed with the abovementioned preferred embodiments, these embodiments are not intended to limit the present invention. Alterations and modifications may be made by those skilled in the art without departing from the spirit and scope of the present invention. Therefore, the true scope of the present invention shall be defined by the appended claims.

What is claimed is:

1. A two-shaft hinge antenna, comprising:

a major conductor provided with stretching arms on both sides thereof, a first insertion hole and a second insertion hole being provided on the ends of the stretching arms, respectively;

a first rotating element configured to be mounted to the first insertion hole of the stretching arm on a side of the major conductor, wherein the first rotating element comprises:

a first vice conductor, a stretching arm on a side thereof is provided with a first fitting hole;

a torque device including a rotating shaft and a plurality of fastening elements, wherein one end of the rotating shaft is mounted to the first insertion hole with a first fastening element of the plurality of fastening elements, while the other end thereof penetrates the first fitting hole of the first vice conductor for mounting the first vice conductor to the torque device; and a second rotating element configured to be mounted to the second insertion hole of the stretching arm on the other side of the major conductor, wherein the second rotating element comprises:

a second vice conductor having a connecting plate with a second fitting hole provided thereon;

a connection device, one end thereof being mounted to the second insertion hole with a second fastening element, while the other end thereof penetrating the second fitting hole of the second vice conductor, the second vice conductor being mounted to the connection device with a third fastening element; and a signal feeding line having a positive end signal lead and a negative end signal lead, wherein the signal feeding line is inserted into the connection device and integrally mounted to the connection device with the third fastening element, in order to transmit a high frequency signal to the major conductor, and further to the torque device connected to the major conductor for forming an antenna loop together with the first vice conductor.

2. The two-shaft hinge antenna of claim 1, wherein the connection device comprises a first coaxial unit, a second coaxial device, a first coaxial inner conductor and a second coaxial inner conductor, after a front end of the second coaxial inner conductor at a stopping section and an end of the first coaxial inner conductor are assembled with each other, a rod portion of the first coaxial inner conductor is inserted into an accommodation recess of the first coaxial unit, and is engaged with an engaging portion of the first coaxial unit through a thread structure formed on an inner surface of the second coaxial unit, thereafter, a rod portion of the second coaxial inner conductor is assembled to the second insertion hole with the second fastening element, and a head portion integrally extending from the engaging portion of the first coaxial unit penetrates the second fitting hole of the second vice conductor for the assembling of the third fastening element.

3. The two-shaft hinge antenna of claim 2, wherein the positive end signal lead of the signal feeding line is electrically connected to the first coaxial inner conductor, and the negative end signal lead is electrically connected to the first coaxial unit.

4. The two-shaft hinge antenna of claim 2, wherein the first coaxial unit includes an insulating layer wrapping the first coaxial inner conductor, and the second coaxial unit includes an insulating layer wrapping the second coaxial inner conductor.

5. A two-shaft hinge antenna, comprising:

a major conductor provided with stretching arms on both sides thereof;

a first rotating element configured to be mounted to the stretching arm on a side of the major conductor, wherein the first rotating element comprises:

a first vice conductor, a stretching arm on a side thereof is provided with a first fitting hole;

a torque device including a rotating shaft and a plurality of fastening elements, wherein one end of the rotating shaft is mounted to the major conductor with a first fastening element, while the other end thereof penetrates the first fitting hole of the first vice conductor for mounting the first vice conductor to the torque device; and a second rotating element configured to be mounted to the stretching arm on the other side of the major conductor, wherein the second rotating element comprises:

a signal feeding line configured to transmit a high frequency signal and having a positive end signal lead and a negative end signal lead;

a microwave base plate having a signal feed-in section and a grounding section, the signal feed-in section including a signal pad electrically connected to the positive end signal lead of the signal feeding line, and the grounding section including a fixing pad for fixing the negative end signal lead of the signal feeding line to the grounding section; and a connection device, one end thereof being connected to the signal pad of the microwave base plate, while the other end thereof being connected to the major conductor for transmitting the high frequency signal to the major conductor, and further to the torque device connected to the major conductor for forming an antenna loop together with the first vice conductor.

6. The two-shaft hinge antenna of claim 5, wherein the connection device includes a metal clip and a rotating member, one end of the rotating member is mount to the major conductor with a second fastening element and a third fastening element, while the other end thereof is held by the metal clip.

7. The two-shaft hinge antenna of claim 5, wherein the connection device includes a rotating member, a first gear, a second gear and a fixing member for securing the second gear, the rotating member penetrates the first gear and is mounted to the major conductor with a second fastening element and a third fastening element, the second gear engages the first gear after the assembling of the second gear and the fixing member.

8. The two-shaft hinge antenna of claim 5, wherein the connection device is a metal spring sheet with a geometric shape, one end of the metal spring sheet with the geometric shape is connected to the signal pad of the microwave base plate, while the other end thereof is connected to an end of the stretching arm on a side of the major conductor.

9. The two-shaft hinge antenna of claim 5, wherein the connection device is a metal clip, one end of the metal clip is connected to the signal pad of the microwave base plate, while the other end thereof is held at an end of the stretching arm on a side of the major conductor.

* * * * *